US005788558A

United States Patent [19]

Klein

[11] Patent Number: 5,788,558

[45] Date of Patent: Aug. 4, 1998

[54] APPARATUS AND METHOD FOR POLISHING LUMENAL PROSTHESES

[75] Inventor: Enrique J. Klein, Los Altos, Calif.

[73] Assignee: Localmed, Inc., Palo Alto, Calif.

[21] Appl. No.: 556,341

[22] Filed: Nov. 13, 1995

[51] Int. Cl.[6] ..... B24B 31/00

[52] U.S. Cl. ..... 451/36; 451/113; 451/61

[58] Field of Search ..... 451/559, 36, 37, 451/104, 113, 61

[56] References Cited

U.S. PATENT DOCUMENTS

| | | | |
|---|---|---|---|
| 3,521,412 | 7/1970 | McCarty | 451/36 |
| 3,634,973 | 1/1972 | McCarty | 451/64 |
| 3,729,871 | 5/1973 | Taylor | 451/36 |
| 3,802,128 | 4/1974 | Minear, Jr. et al. | 451/64 |
| 3,819,343 | 6/1974 | Rhoades | 51/302 |
| 3,823,514 | 7/1974 | Tsuchiya | 451/36 |
| 4,005,549 | 2/1977 | Perry | 451/36 |
| 4,776,337 | 10/1988 | Palmaz | 128/343 |
| 4,781,186 | 11/1988 | Simpson et al. | 128/305 |
| 4,936,057 | 6/1990 | Rhoades | 451/36 |
| 4,996,796 | 3/1991 | Rhoades | 451/114 |
| 5,054,247 | 10/1991 | Rhoades et al. | 451/36 |
| 5,070,652 | 12/1991 | Rhoades et al. | 451/113 |
| 5,076,027 | 12/1991 | Rhoades | 451/37 |
| 5,102,417 | 4/1992 | Palmaz | 606/195 |
| 5,125,191 | 6/1992 | Rhoades | 451/36 |
| 5,195,984 | 3/1993 | Schatz | 606/195 |
| 5,226,909 | 7/1993 | Evans et al. | 606/159 |
| 5,367,833 | 11/1994 | Rhoades et al. | 451/104 |
| 5,421,955 | 6/1995 | Lau et al. | 216/48 |

OTHER PUBLICATIONS

Rhoades, L.J., "Abrasive Flow Machining –Progress in Productivity," *Conf. for Select Automatic Deburring*, pp. 1–15, Mar. 1993.

*Primary Examiner*—Robert A. Rose

*Attorney, Agent, or Firm*—Townsend and Townsend and Crew LLP

[57] ABSTRACT

Methods and apparatus for deburring and rounding edges and polishing surfaces of radially expansible lumenal prostheses, such as stents and grafts, are provided. A stent (2) is mounted onto a polishing apparatus (58) and a flowable abrasive slurry is extruded through the apparatus in abrading contact with inner and outer surfaces (28, 29) and circumferential openings (30) in the stent. To polish the cut surfaces (32) and edges (34, 36) surrounding the openings, the abrasive slurry is introduced into an inner lumen (26) of the stent and extruded radially outward through the openings. The inner and outer wall surfaces 28, 29 are preferably pre-polished prior to cutting the slot pattern (i.e., openings 30) in the stent.

50 Claims, 7 Drawing Sheets

APPARATUS AND METHOD FOR POLISHING LUMENAL PROSTHESES

BACKGROUND OF THE INVENTION

1. Field of the Invention

The present invention relates generally to radially expansible lumenal prostheses and more particularly to an apparatus and method for polishing the cut edges and wall surfaces of lumenal prostheses.

Lumenal prostheses, commonly known as stents, are tubular shaped devices which function to hold open a segment of a blood vessel or other anatomical lumen. These stents are provided for a variety of medical purposes. For example, stents can be placed in various body lumens, such as blood vessels, and the ureter, urethra, biliary tract, and gastrointestinal tract, for maintaining patency. Stents are particularly suitable for supporting dissections in the arterial tissue that may occur during, for example, balloon angioplasty procedures. Such dissections can occlude an artery and prevent the flow of blood therethrough. In addition, stents may be used as grafts for supporting weakened bloods vessels, such as in aortic aneurysm repair procedures.

Many types of stents are typically manufactured from a tubular material, such as hypodermic tubing made of stainless steel, or a nickel titanium alloy (i.e., nitinol), that when formed into a stent can be made to expand radially. Such stents have the mechanical hoop strength to maintain lumen patency and/or mechanically augment the lumenal wall strength. Stents of this configuration typically comprise a hollow tubular body member with a plurality of struts or beam elements which deform as the stent expands radially from a small introducing diameter to a larger deployed diameter. After radial expansion, the struts or beam elements define openings therebetween having cut edges and side surfaces that come into contact with the vessel wall and the blood stream.

An important parameter in manufacturing and finishing stents is the smoothness of the inner and outer surfaces of the body member and the surfaces and edges of the openings between the beams or body elements. This is particularly important for several reasons. Foremost among these reasons is that rough, metallic surfaces may present foci for platelet aggregation, which is known to result in thrombus formation and may lead to abrupt closure of the stented vessel unless a strict anticoagulation regime is followed, which may lead to yet other complications. Also, malleable stents, such as stainless steel stents, are often deployed using standard or high pressure angioplasty balloons. Such balloons are made from very thin and strong polymeric materials which have been known to burst when expanding a malleable stent due to the sharp edges on the stent cutting into the balloon and causing it to rupture. In addition, sharp metallic edges on the stent may injure or traumatize the blood vessel walls as the stent is delivered through and/or radially expanded within the blood vessel.

Prior methods of manufacturing stents from hypodermic tubing include coating the external surface of the tube with a photoresist material, optically exposing the etch pattern using a laser beam while translating and rotating the part and then chemically etching the desired slot pattern of the stent using conventional techniques. A description of this technique can be found in U.S. Pat. No. 5,421,955 to Lau, the complete disclosure of which is incorporated herein by reference. In other methods, laser cutting technology is used in conjunction with computer controlled stages to directly cut a pattern of slots in the wall of the hypodermic tubing to obtain the desired stent geometry. These chemical etching and laser cutting methods, however, produce stents in which the slots have rough surfaces with slag particles and other debris attached. In addition, these methods often produce sharp metallic edges or burrs which could rupture an angioplasty balloon or damage the anatomical lumen. Conventional deburring methods, such as bead blasting and tumbling with abrasive media generally cannot be used with stents because the stents are extremely small (on the order of 1.5 mm diameter) and fragile and, therefore, difficult to handle. In addition, in the case of abrasive media, the slots are too small for the medium to penetrate and abrade the edges and cut surfaces.

Currently used technology for deburring and polishing stents involves a process called electropolishing. Electropolishing is a bulk process for removing the sharp corners and edges as well as polishing the wall surfaces and cut surfaces of metallic stents. This technology comprises a reverse electroplating process in which stents are preferably supported by a conductive wire and submerged in a caustic liquid solution, such as a mixture of phosphoric and sulfuric acid. A cathode is also submerged into the electrolytic solution so that an electric potential can be established between the cathode and the anode. The electric potential removes metallic material from the stent to thereby polish the wall surfaces and round the edges of the stent.

Although electropolishing technology improves the macroscopic appearance of the stent surfaces, stents polished by this process suffer from a number of disadvantages. One disadvantage is that electropolishing is relatively ineffective in removing the upraised burrs, slag and debris from the cut edges of the stent. This means that to properly deburr and round off the edges, it is often necessary to remove as much as 0.025 mm from the exposed surfaces, including the inner and outer wall surfaces as well as the cut surfaces of the stent. Since the wall thickness of a finished stent is typically in the range of 0.075 mm to 0.1 mm and since the tubing material may originally be on the order of 0.125 mm to 0.15 mm in thickness, removing up to 40% of the material thickness makes it difficult to control the overall uniformity of the stent geometry.

Another disadvantage of having to remove up to 0.025 mm from all surfaces is that the resulting surface, while macroscopically smooth and shiny, becomes cratered and even pitted when viewed under the microscope. In the case, e.g., of type 316 stainless steel (a favored material in the manufacture of malleable stents), the surface on the inner cylindrical surface becomes more cratered than the outer cylindrical surfaces, and the cut surfaces become deeply pitted. As mentioned above, this may have profoundly damaging consequences for the thrombogenicity of the stent when implanted in an artery and exposed to the bloodstream.

For these and other reasons, it would be desirable to provide methods and apparatus for effectively deburring the edges and polishing the wall surfaces and cut surfaces of stents. These methods and apparatus should be capable of removing burrs and particles from the edges and the wall surfaces of the stent to provide a microscopically smooth surface. Furthermore, this deburring and polishing should be accomplished by removing a minimal amount of material from the wall surfaces. Additionally, the stent should be handled delicately without causing any structural damage or distortion during the polishing process.

2. Description of the Background Art

U.S. Pat. No. 5,421,955 to Lau describes a method for manufacturing a radially expansible stent by chemically etching hypodermic tube, and then electropolishing the stent in an aqueous solution to polish the stent. U.S. Pat. Nos. 3,634,973 and 3,521,412 to McCarty and 5,367,833, 5,070,652, 4,936,057 and 3,819,343 to Rhoades describe methods and apparatus for abrading and deburring metal parts with an abradable medium, such as silicone putty loaded with very fine abrasive media, a process also known as abrasive flow machining. These methods comprise mounting the metal parts to be deburred and polished onto a machine and forcing the abradable medium over the surfaces of the metal parts to polish and deburr the surfaces and edges.

SUMMARY OF THE INVENTION

The present invention provides methods and apparatus for deburring the edges and for polishing the surfaces of radially expansible lumenal prostheses, such as stents and grafts. The invention involves mounting a lumenal prosthesis onto a fixture and radially extruding an abrasive slurry through circumferential openings in the prosthesis in abrading contact with cut surfaces and edges surrounding these openings. The abrasive slurry can be selectively directed through the small openings and passages defined by the struts or beams of the stent to remove upraised slag and metallic particles, especially on the cut wall surfaces, thereby providing a microscopically smooth surface. In addition, the flow of the slurry can be effectively controlled so that the burrs and the stent edges are rounded with a minimum amount of surface material being removed from the wall surfaces of the stent.

Lumenal prostheses or stents typically comprise a cylindrical metallic, elongate body sized for delivery through an anatomical lumen and having first and second open ends and an inner lumen therebetween. Such stents typically have an outside diameter in the range of 1.5 mm to 5.0 mm and a length in the range of 8 mm to 30 mm. The elongate body of the stent comprises a plurality of strut or beam elements that define narrow slots and small openings when the stent has been manufactured out of hypodermic tubing. When the stent is radially expanded within an anatomical lumen, the narrow slots will expand to form a generally rhomboidal and/or serpentine body structure suitable for the formation of a scaffold for supporting an anatomical lumen. The method of the present invention includes mounting the stent as manufactured to a fixture or polishing apparatus so that at least a portion of the stent is positioned adjacent an interior wall of the apparatus to define a restrictive flow passage therebetween. A flowable abrasive media comprising abrasive grains dispersed in a pliable matrix forming a viscous slurry is then extruded through the restrictive flow passage to abrade or polish the portion of the stent.

To effectively deburr the edges and polish the cut surfaces surrounding the small body openings in the stent, the abrasive slurry is introduced into the inner lumen of the stent and extruded radially outward through these openings over a relatively short longitudinal portion of the stent. Preferably, the slurry is introduced under pressure directly into the central portion of the inner lumen via one or two delivery tubes. The flow of the slurry may be reversed so that it is radially extruded inwardly through the openings and then discharged through the delivery tube(s). This reversal in the flow of the slurry through the small body openings of the stent will ensure more uniform deburring of both the inner and outer edges of the stent.

A portion of the slurry may also be extruded axially past the inner surfaces of the stent and the outer surface of the delivery tube(s) to remove material from the inner surfaces of the stent. The outer surfaces of the stent may also be polished by axially directing the abrasive slurry through restrictive passages between outer surfaces of the stent and a hole in the fixture surrounding the stent. The stent may be axially reciprocated and/or rotated within this hole so that the flowing slurry will come into abrading contact with substantially all of the edges and the wall surfaces of the stent. Preferably, however, the metallic hypodermic tubing will be polished both on its outer and inner surfaces before the stents are manufactured thus limiting the deburring and polishing operation of the finished stent mainly to the edges and newly cut surfaces of the stent. In this manner, the material removed from the stent will be in the range of 0.005 mm to 0.01 mm instead of about 0.025 mm, which is the amount of material currently being removed with electropolishing techniques. Furthermore, the surface roughness of stents polished by the electropolishing process will generally be greater than $R_a$=0.8 microns. On the other hand, stents polished by means of the present invention may result in surfaces having a surface roughness of less than $R_a$=0.4 microns. Polishing the outer surface of the tube is best accomplished by conventional centerless grinding while polishing of the inside of the tube is best accomplished by abrasive flow machining.

The flowable abrasive material preferably comprises a pliable semisolid carrier and a concentration of abrasive grains. The carrier or media holds the abrasive particles in suspension and transports them through the restrictive passages defined by the stent. The abrasive particles remove burrs from edges and round edges and corners, as well as smoothing and polishing metal on the wall surfaces of the stent. The preferred media for use in the present invention are polyborosiloxanes, which may be plasticized, usually with silicone fluids, to a suitable low shear viscosity to allow passage of the abrasive slurry through narrow slots with minimal pressure drop. The medium is filled with an appropriate charge of suitable abrasive grains, such as silica, alumina, carborundum, garnet, tungsten carbide, silicon carbide, diamond, boronic carbide and the like.

The apparatus of the present invention comprises a base defining a chamber with an interior wall sized to receive at least a portion of the stent and a mount for holding the stent so that it is at least partially disposed within the chamber. A fluid conduit has an inlet for receiving an abrasive slurry and a passage for delivering the abrasive slurry into restrictive passages defined by the outer surfaces and the interior lumenal wall of the stent. The apparatus further includes a pair of receiving/delivery tubes positioned through the open ends of the tubular extensions of the stent for receiving or delivering the abrasive slurry from or into an interior portion of the stent. The tubes are sized and positioned to allow the slurry to primarily radially extrude through the slots or openings in the stent. Secondarily, the slurry will flow between the outer surface of the tubes and the lumen or the inner surfaces of the stent and between the outer surfaces of the stent and the surrounding chamber walls of the base.

In a specific configuration, lateral extensions of the lumenal prosthesis are mounted to a pair of mounting arms so that the stent extends through a hole in the base. The hole defines an annular gap between the outer surface of the inlet/outlet tubes and the interior walls of the hole. The mounting arms are coupled to a drive for reciprocating and/or rotating the prosthesis within the hole during the abrading process. The receiving/delivery tubes remain fixed relative to the base during reciprocation of the prosthesis.

Other features and advantages of the invention will appear from the following description in which the preferred embodiment has been set forth in detail in conjunction with the accompanying drawings.

DESCRIPTION OF THE SPECIFIC EMBODIMENTS

Figure 1:
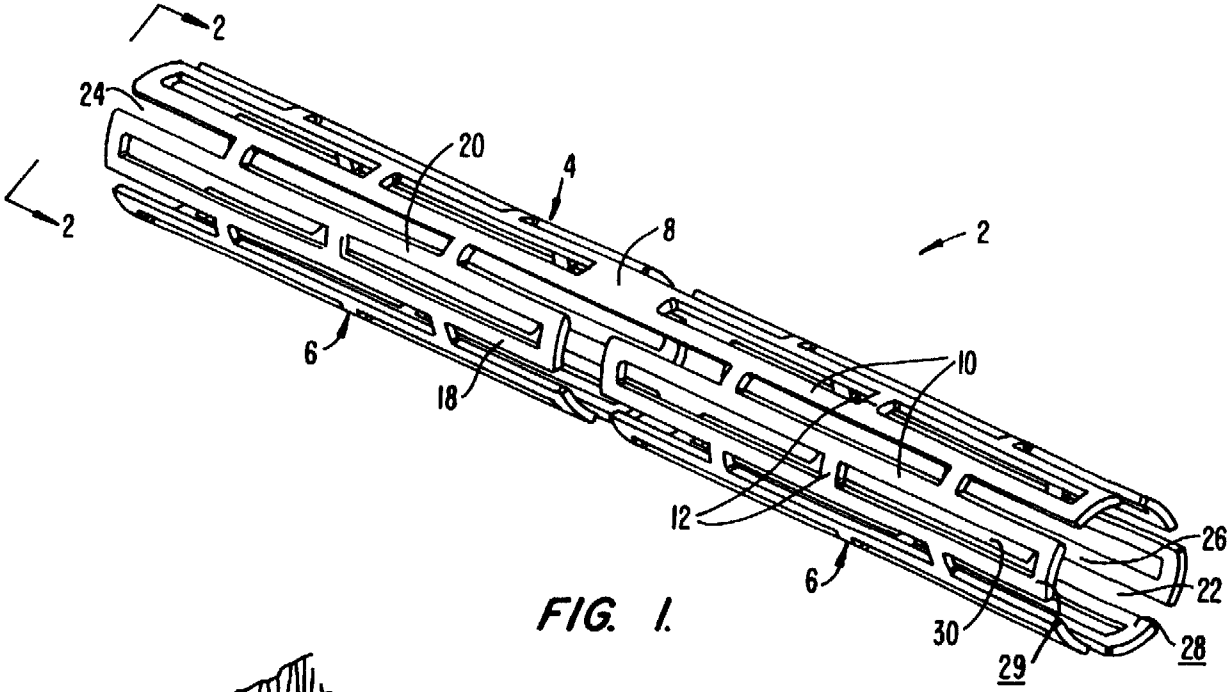
FIG. 1 is a perspective view of a representative prior art stent in a collapsed configuration.
Figure 2:
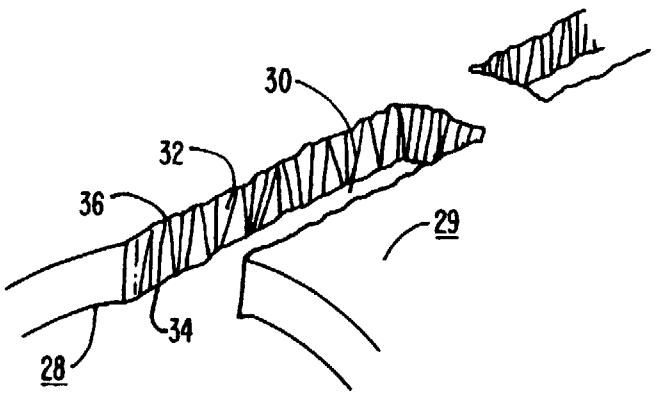
FIG. 2 is a partial detailed view of one of the circumferential openings in the stent of FIG. 1, taken along line 2—2, illustrating the rough edges and rough cut surfaces surrounding the opening.
Figure 3:
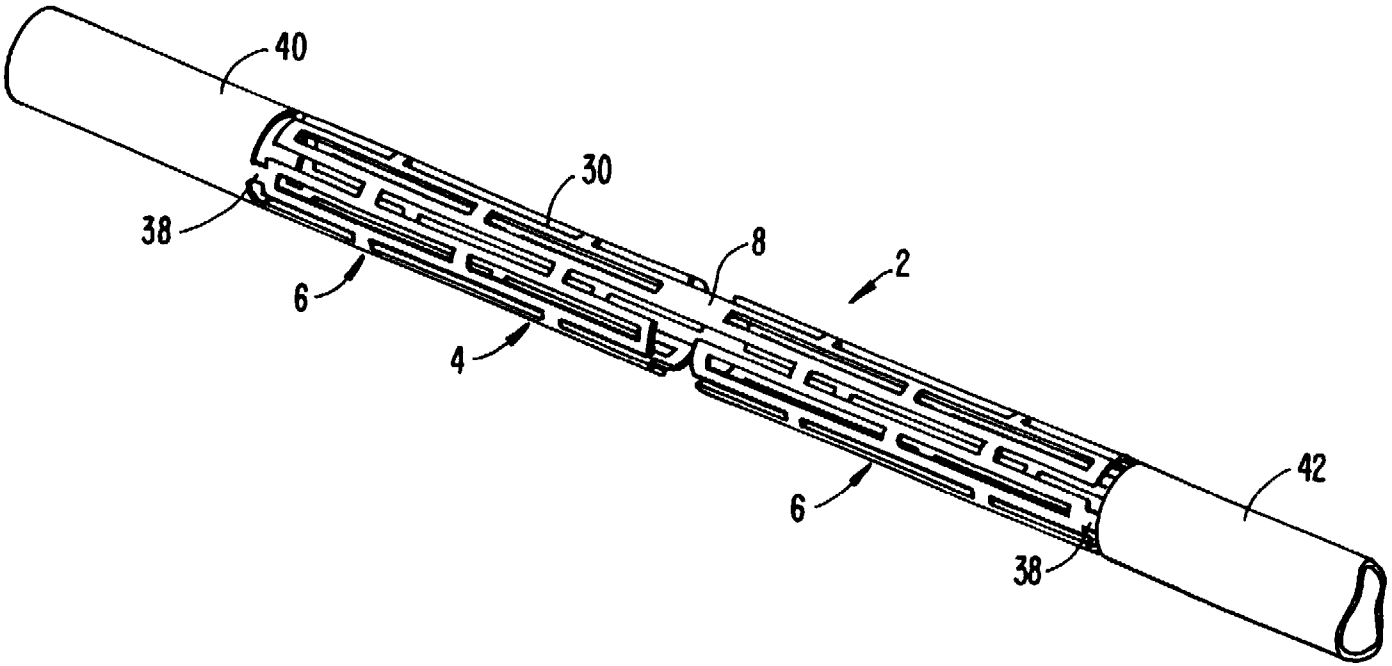
FIG. 3 is a perspective view of the stent of FIG. 1 connected to a pair of tubular extensions.

FIGS. 1–3 illustrate a representative intravascular stent structure adapted for delivery into a blood vessel or other anatomical lumen. It should be understood, however, that although a particular stent structure is described below and shown in FIGS. 1–3, the present invention is not intended to be limited to this structure. That is, the method and apparatus of the present invention can be utilized to deburr and polish a variety of stents commonly used in this art. For example, representative conventional stent structures made from metallic tubular materials that are currently marketed as implants for coronary, peripheral, biliary and other vessels include the Palmaz-Schatz™ balloon expandable stent, manufactured by Johnson and Johnson Interventional Systems, Co. and made from malleable stainless steel hypodermic tubing; and the Memotherm® stent, manufactured by Angiomed, a division of C. R. Bard, Inc., manufactured out of nitinol tubing which takes advantage of a shape memory effect to reach its deployed size. In both of these examples, a series of offset slots in the surface of the collapsed stent are deformed when the stent is deployed into its expanded configuration.

In a typical embodiment, a stent structure 2 is preferably constructed of a thin walled stainless steel hypodermic tubing having a wall thickness in the range of 0.125 mm to 0.15 mm and having a relatively small collapsed diameter in the range of 1.5 mm to 5.0 mm to fit within small tortuous anatomical lumens within the body. In FIG. 1, stent 2 is shown in a radially collapsed, (i.e., as manufactured configuration) and in the example shown, comprises a hollow elongate body 4 having two radially expansible body segments 6 joined by one axial articulation tab 8. The body segments each include a number of slots forming box structures 10 which are circumferentially joined by tabs 12. It will be appreciated that the box structures 10, comprised of beam members 18 and 20, will radially expand as the stent is expanded in a conventional manner, e.g., by application of an internal balloon force where the stent is made from a malleable material, such as stainless steel. More detailed descriptions of malleable stents are provided in U.S. Pat. Nos. 5,102,417 and 4,776,337 to Palmaz and U.S. Pat. No. 5,195,984 to Schatz. A more advanced stent structure incorporating multiple articulations along its length is provided in commonly assigned, co-pending application Ser. No. 08/463,166 to Klein, filed on Jun. 5, 1995, the complete disclosure of which is incorporated herein by reference.

In addition to plastically deformable stents, the present invention will be suitable for deburring and polishing self-expanding stents formed from resilient materials, such as shape memory alloys, e.g., nitinol. Such stents will be formed so that they are expanded at room and/or body temperature and are delivered in a constrained and/or unconstrained, cooled condition. Once in position in the vasculature or other body lumen, the stent will radially expand due to the resiliency and/or shape memory of its own structure. Such stents are described, for example, in WO 94/17754 (the complete disclosure of which is incorporated herein by reference), where a nitinol stent is machined from a nitinol tube.

As shown in FIG. 1, elongate body 4 of stent structure 2 includes open ends 22, 24 for receiving an expandable balloon on the distal end of a catheter (not shown) within an internal lumen 26 in body 4. All of the individual elements of stent 2 (i.e., box structures 10, comprised of beam members 18, 20, tabs 12 and tab 8) define inner and outer wall surfaces 28, 29 and a plurality of longitudinal openings 30 between the elements. As best shown in FIG. 2, circumferential openings 30 define side or cut surfaces 32 surrounding openings 30 and inner and outer cut edges 34, 36 between the inner and outer surfaces 28, 29 of the stent elements, respectively. These edges and surfaces are shown as cut, for example, by a laser beam, including slag at the edges 34 and 36 (not shown) and rough surfaces 32. The inner surfaces and cut edges of the completed stent will contact the expansion balloon and will be exposed to the blood stream. In addition, the outer surfaces will contact the blood vessel wall and the side surfaces will be exposed to the blood stream. Therefore, all of the completed stent surfaces should be as smooth and rounded as possible to avoid rupture of the balloon, damage to the vessel wall and/or the creation of foci for platelet aggregation therein.

FIG. 3 illustrates the exemplary stent structure 2 of FIG. 1 having a pair of tubular extensions 40, 42 (shown shortened for convenience). Tubular extensions 40 are provided to facilitate the handling of the delicate stent structure 2 after the slots 30 have been cut, and to enable the fixturing of the stent configuration of FIG. 3 within the polishing apparatus of the present invention (described below). Tubular extensions 40, 42 are attached to the elongate body 4 typically by three circumferentially distributed tabs 38, which are severed and smoothed out after completion of the deburring and polishing operation and after an inspection process. Tubular extensions 40, 42 are hollow elongate members having a diameter substantially equal to the diameter of stent 2 and usually being part of the tubing that the stent was manufactured from.

Figure 4:
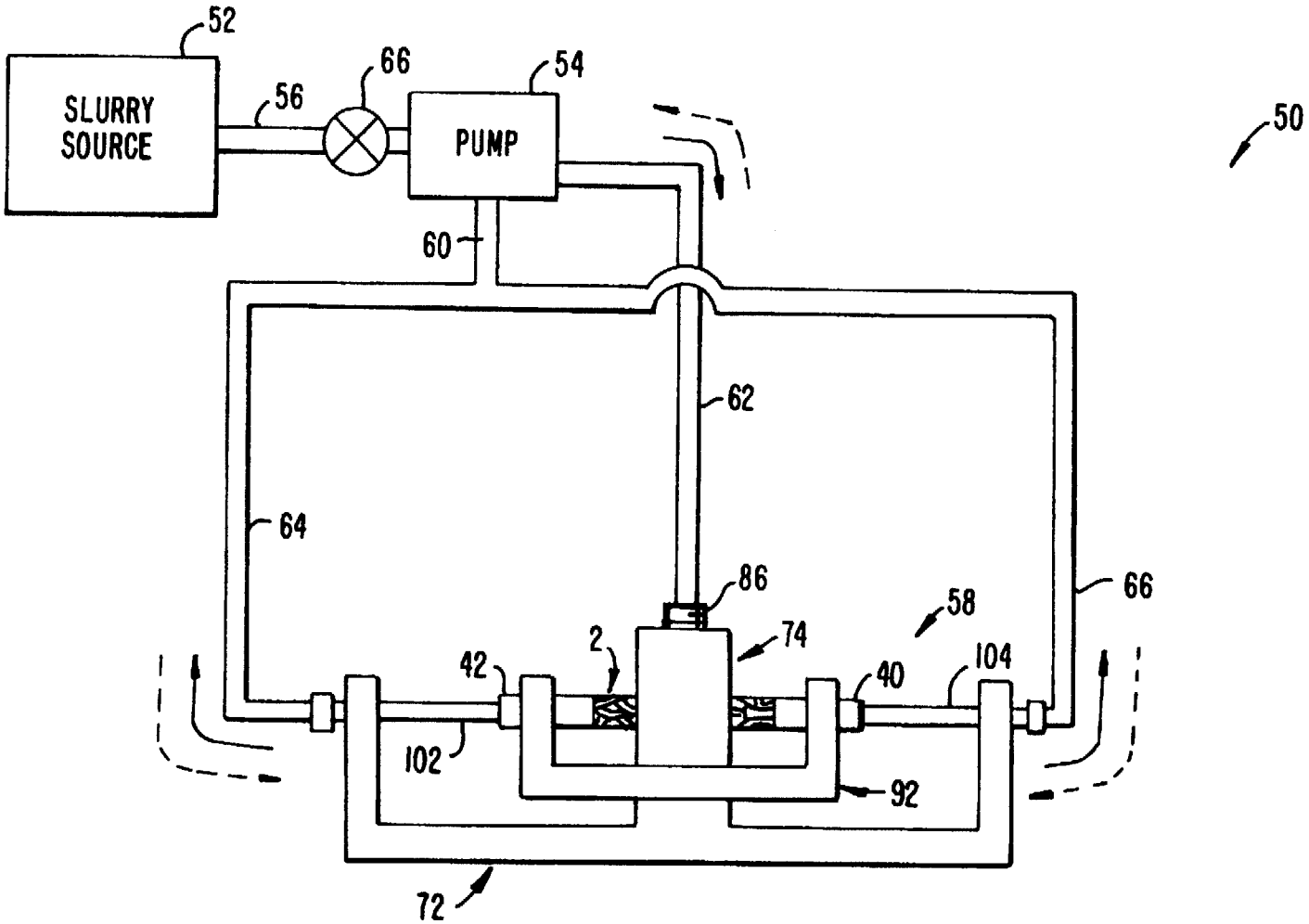
FIG. 4 is a schematic representation of a system for polishing a lumenal prosthesis.

FIG. 4 illustrates a hydraulic system 50 for polishing a lumenal prosthesis, such as the stent 2 described above and illustrated in FIGS. 1–3. System 50 comprises a source of abrasive slurry 52 fluidly coupled to a polishing apparatus 58 for mounting stent 2 thereto and primarily to deburr the edges and polish the cut surfaces of stent 2 with the abrasive slurry. System 50 may also secondarily abrade and polish the outer and inner surfaces of stent 2. System 50 includes a pump 54 to pressurize the abrasive slurry and propel it alternatively through fluid conduits 60 or 62, delivering the slurry to polishing apparatus or fixture 58. Hydraulic system 50 will preferably comprise a closed loop pumping system including a pump 54 in the form of a large capacity, fully controlled, double acting, positive displacement pump. The slurry source 52 is connected to pump 54 via conduit 56 and valve 66 and mainly serves to replace spent slurry or replenish slurry lost in the process due to leakage in the system (since the slurry can be repeatedly recirculated, as discussed below). On a first stroke, abrasive slurry is discharged through conduit 60 via branches 64 and 66 into polishing apparatus 58 through delivery tubes 102 and 104 and, after passing through, is returned to the pump 54 out of port 86 through conduit 62. (following the direction of the broken arrows). On a second stroke, the abrasive slurry may be discharged from pump 54 through conduit 62 following a reverse path through the polishing assembly, as indicated by the solid arrows.

It should be noted that the invention is not limited to any one system for delivering the abrasive slurry to polishing apparatus 58. A variety of mechanisms for forcing a viscous fluid through small restrictive passages with large pressure drops can be used, such as reciprocating single or double acting piston pumps, rotating screws or the like.

Figure 5:
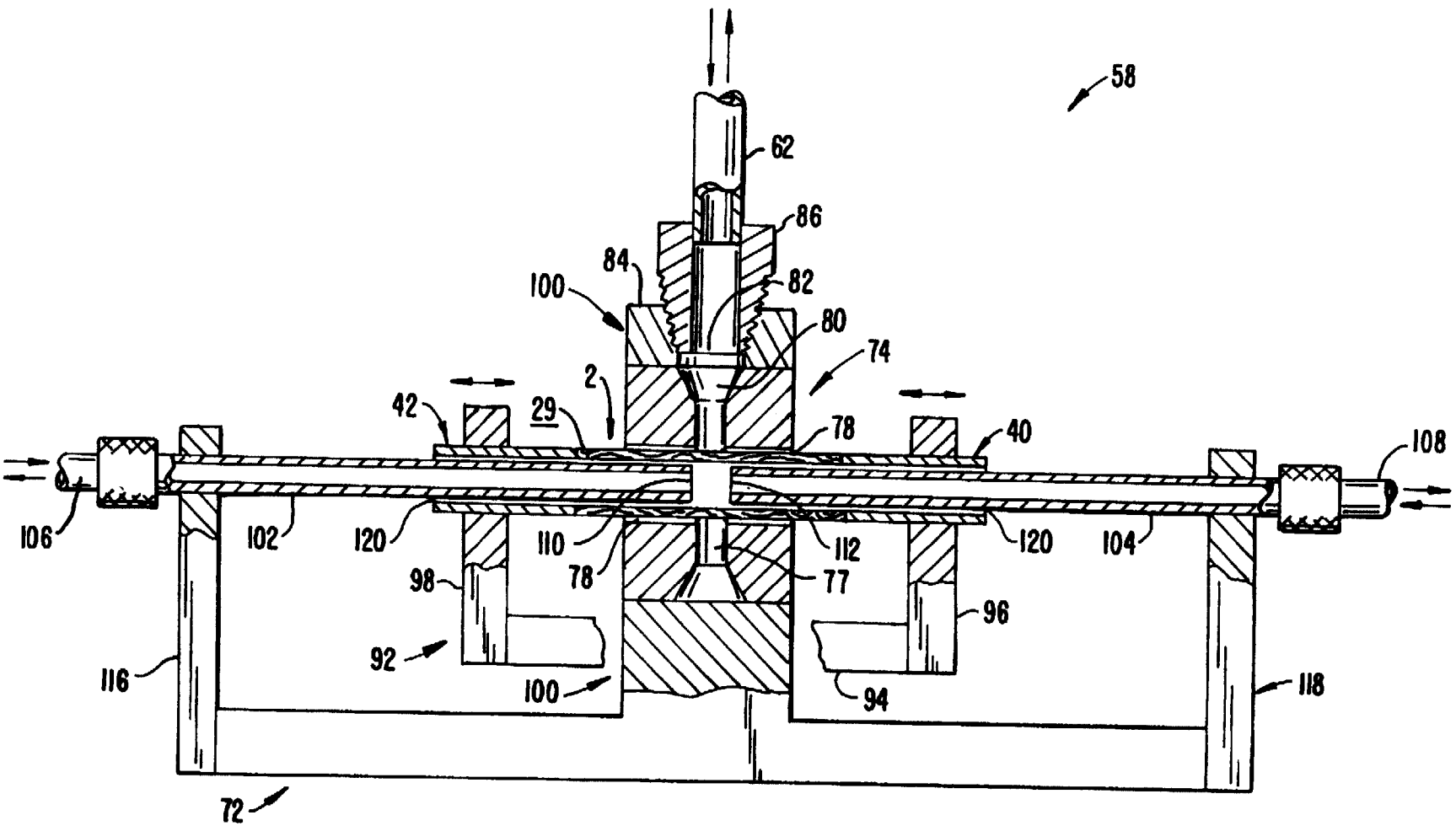
FIG. 5 is a side cross-sectional view of the stent and tubular extensions of FIG. 3 mounted to the apparatus of the polishing system of FIG. 4.
Figure 6:
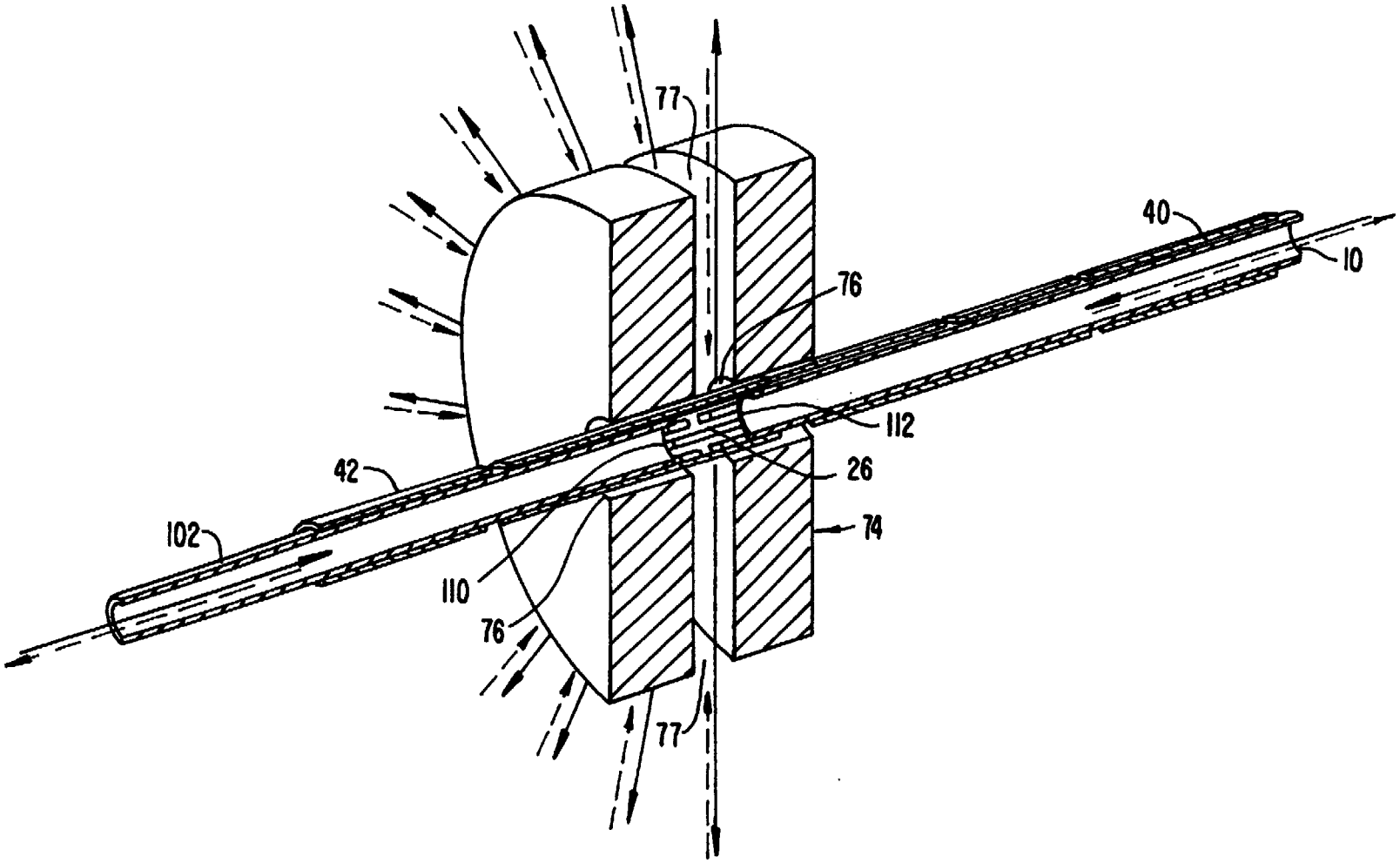
FIG. 6 is a partial isometric cross section of a stent in the apparatus of the polishing system of FIG. 4, illustrating the flow of abrasive slurry.

As shown in FIG. 5 and partially in FIG. 6, polishing apparatus 58 comprises a base 72 and a cylindrical body 74 mounted to an upward extension 100 of base 72 forming a cylindrical housing 84 for body 74. Body 74 defines a cylindrical hole 76 (best seen in FIG. 6) for receiving at least a portion of stent 2. Hole 76 preferably has a length that is less than the length of stent 2. One end of cylindrical housing 84 includes an opening 82 opposite base 72 for receiving a threaded fitting 86. As shown in FIG. 5, fitting 86 threadably couples fluid line 62 to cylindrical housing 84, and therethrough to body 74 so that the abrasive slurry can be delivered to (or discharged from) hole 76 through conduit 62. Polishing apparatus 58 further includes a conduit assembly for delivering the abrasive slurry into inner lumen 26 of stent 2. Preferably, the conduit assembly includes first and second delivery tubes 102, 104 extending through open ends 22, 24 of stent 2 into the central portion of inner lumen 26, as shown in FIG. 5. Delivery tubes 102, 104 have inlets/outlets 106, 108 coupled to fluid conduit branches 64, 66 and outlets/inlets 110, 112 positioned opposite each other within inner lumen 26 for delivering the abrasive slurry therein. Delivery tubes 102, 104 are supported by a pair of stands 116, 118 suitably mounted to base 72. Tubes 102, 104 are preferably removably attached to stands 116, 118 to facilitate the mounting and subsequent removal of stent 2 from the polishing apparatus.

As best shown in FIG. 6, cylindrical body 74 of polishing apparatus 58 further defines a narrow disk shaped gap 77 surrounded by a tapered annular chamber 80 (FIG. 5) in communication with hole 76. In a first operation, defined by flow following the broken arrows in FIG. 4, slurry flows through tubes 102, 104 into inner lumen 26 of prosthesis 2, where it is forced radially outward through openings 30 into gap 77, as indicated by the arrows in FIG. 6. Gap 77 preferably completely surrounds the prosthesis to ensure that the slurry will extrude through the openings 30 around the entire circumference of the prosthesis. Of course, it should be noted that the invention is not limited to this configuration and the polishing apparatus can include a chamber that does not fully surround the stent, together with means for rotating the stent.

Polishing apparatus 58 primarily abrades the edges 34, 36 and cut surfaces 32 of openings 30. The inner and outer surfaces 28, 29 are preferably polished prior to this process in, for example, a similar process that abrades these surfaces before the openings 30 are cut into the prosthesis body. However, polishing apparatus 58 may be utilized to secondarily polish inner and outer surfaces 28, 29 while the cut surfaces and edges are being polished. To that end, hole 76 has a diameter slightly greater than the diameter of stent 2 to define an annular restrictive passage 78 between body 74 and the outer surfaces 29 of stent 2 when the stent is mounted therein (as best shown in FIG. 5). Restrictive passage 78 is preferably sized so as to allow a small portion of the abrasive slurry to flow therethrough in abrading contact with the outer surfaces 29 of stent 2.

Also, as shown in FIG. 5, delivery tubes 102, 104 are preferably sized to define an annular gap or restrictive passage 120 between the outer surface of tubes 102, 104 and the inner surfaces 28 of stent 2. This restrictive passage should be small enough so that annular passage 120 offers substantially more resistance to the abrasive flow than the circumferential openings 30 in the body of stent 2. This will allow a small portion of the abrasive slurry to flow through annular passage 120 to thereby polish inner surfaces 28 of the stent. The size of annular passages 78 and 120 will be determined mainly by the consistency of the abrasive slurry and the axial lengths of the respective annular passages, and will further be constrained so that a substantial portion of the abrasive slurry will flow radially outward through openings 30 after it has been delivered into the inner lumen 26 of the prosthesis 2.

As shown in FIG. 5, mounting apparatus 58 further includes a movable frame 92 for reciprocating stent 2 within hole 76 so that the entire length of stent 2 may be disposed within hole 76 during the course of the abrasive operation. With this configuration, the abrasive slurry will be in abrading contact with all of the cut surfaces 32 and edges 34, 36 of openings 30 as it is radially extruded from the inner lumen of stent 2 into chamber 77 through openings 30 over a limited axial length of the stent 2. In a specific embodiment, frame 92 includes a base portion 94 movably coupled to base 72 and having first and second mounting arms 96, 98 extending upward from base portion 94 on opposite sides of body 74, as shown in FIG. 5. Mounting arms 96, 98 each have an opening for receiving tubular extensions 40, 42 (see FIG. 3), which can be suitably attached to arms 96, 98 by conventional fastening means, such as a chuck or a collet mechanism. Preferably, frame 92 is coupled to base 72 by a linear guidance mechanism and driven through a lead screw powered by a microprocessor controlled electrical motor (not shown). The edges and cut surfaces of a cylindrical portion of the stent will all be polished simultaneously (the portion centered with disk shaped gap 77). To polish all of the surfaces on the entire length of the stent, the stent will be reciprocated longitudinally from end to end.

The preferred abrasive slurry of the present invention comprises a pliable semisolid carrier having a concentration of abrasive grains. The carrier or media preferably has sufficient body at high pressure and low velocity to provide backing for the abrasive particles so that the abrasive particles are pressed against the surface to be treated with sufficient force to obtain the desired deburring and polishing result. The media will preferably be of a suitably low viscosity which is generally appropriate for deburring edges and for polishing small passages. The preferred carrier or media for use in the present invention are polyborosiloxanes, which may be plasticized, usually with silicone fluids, to a suitably low shear viscosity. One suitable medium is silicone putty, i.e., borosiloxane, of a suitable grade. A more thorough discussion of abrasive slurries appropriate for the present invention can be found in U.S.

Pat. Nos. 3,634,973 and 3,521,412 to McCarty and 5,367,833, 5,070,652, 4,936,057 and 3,819,343 to Rhoades, the full disclosures of which are incorporated herein by reference.

The media is filled with an appropriate charge of a suitable abrasive grain, such as silica, alumina, carborundum, garnet, tungsten carbide, silicon carbide, diamond, boron carbide and the like. Normally, the content of abrasive material per part of putty material will be from about two parts to about fifteen parts by weight. Typically, abrasive particle size ranges from 0.005 mm to 1.5 mm. Larger size abrasive particles effect deeper cuts per grain. It is also possible to employ abrasive flow machining or polishing in multiple steps, with the initial stage being conducted with an abrasive medium containing larger size abrasive particles and subsequent abrasive flow operations being conducted with abrasive media containing finer abrasive particles.

The method for polishing the surfaces 28, 29, 32 and deburring and rounding edges 34, 36 of stent 2 will now be described with reference to FIGS. 1–6. The stent is in a collapsed configuration, as shown in FIG. 1, but includes tubular extensions 40, 42 (FIG. 3) for fixturing within apparatus 58, as shown in FIG. 3. Stent 2 is then positioned within hole 76 of cylindrical body 74 and tubular extensions 40, 42 are mounted to arms 96, 98 of frame 92 (see FIGS. 5 and 6). Delivery tubes 102, 104 are then introduced through the stent internal lumen 26, leaving a longitudinal gap between ends 110 and 112, centered with and slightly larger than gap 77 in body 74.

As shown in FIGS. 5 and 6, in a first operation mode, the abrasive slurry flows through delivery tubes 102, 104 and into the exposed gap of inner lumen 26 of stent 2. Once the abrasive slurry has substantially filled the space between the opposing outlets 110, 112 of delivery tubes 102, 104, it will extrude through circumferential openings 30 in the body 4 of stent 2 in abrading contact with cut surfaces 32 and edges 34, 36 (FIG. 2). A portion of the abrasive slurry may also extrude through restrictive passages 120 between inner surfaces 28 of stent 2 and the outer surface of delivery tubes 102, 104 to thereby abrade the inner surfaces 28 of the stent.

As shown in FIG. 5, the portion of abrasive slurry that passes through restrictive passages 120 inside of stent 2 and tubular extensions 40, 42, will be suitably discharged through the open ends of the tubular extensions. The portion of slurry that extrudes through openings 30 will pass radially through gap 77 (FIG. 6) to be channelled via chamber 88 into fitting 86 and back to pump 54 through conduit 62. A portion of this slurry will also flow through restrictive passages 78 between the inner surface of hole 76 and the outer surfaces 29 of stent 2 to thereby abrade the outer surfaces 29 of the stent. To expose the remaining openings 30 with surfaces 32 and edges 34, 36 of stent to the flow of abrasive slurry, frame 92, holding the stent with tubular extensions 40, 42 through arms 96, 98, must be traversed relative to stationary frame 72 until the entire length of stent 2 has been processed.

To fully polish both the outer and inner edges 34, 36 of the openings 30 in stent 2, the above described flow process may be reversed in a second operation mode, wherein the abrasive slurry enters apparatus 58 through conduit 62 and exits through tubes 102, 104. In this mode, the traversing of the frame 92 relative to stationary frame 72 is repeated as in the first operation mode until stent 2 is fully and uniformly deburred and polished.

Figure 7:
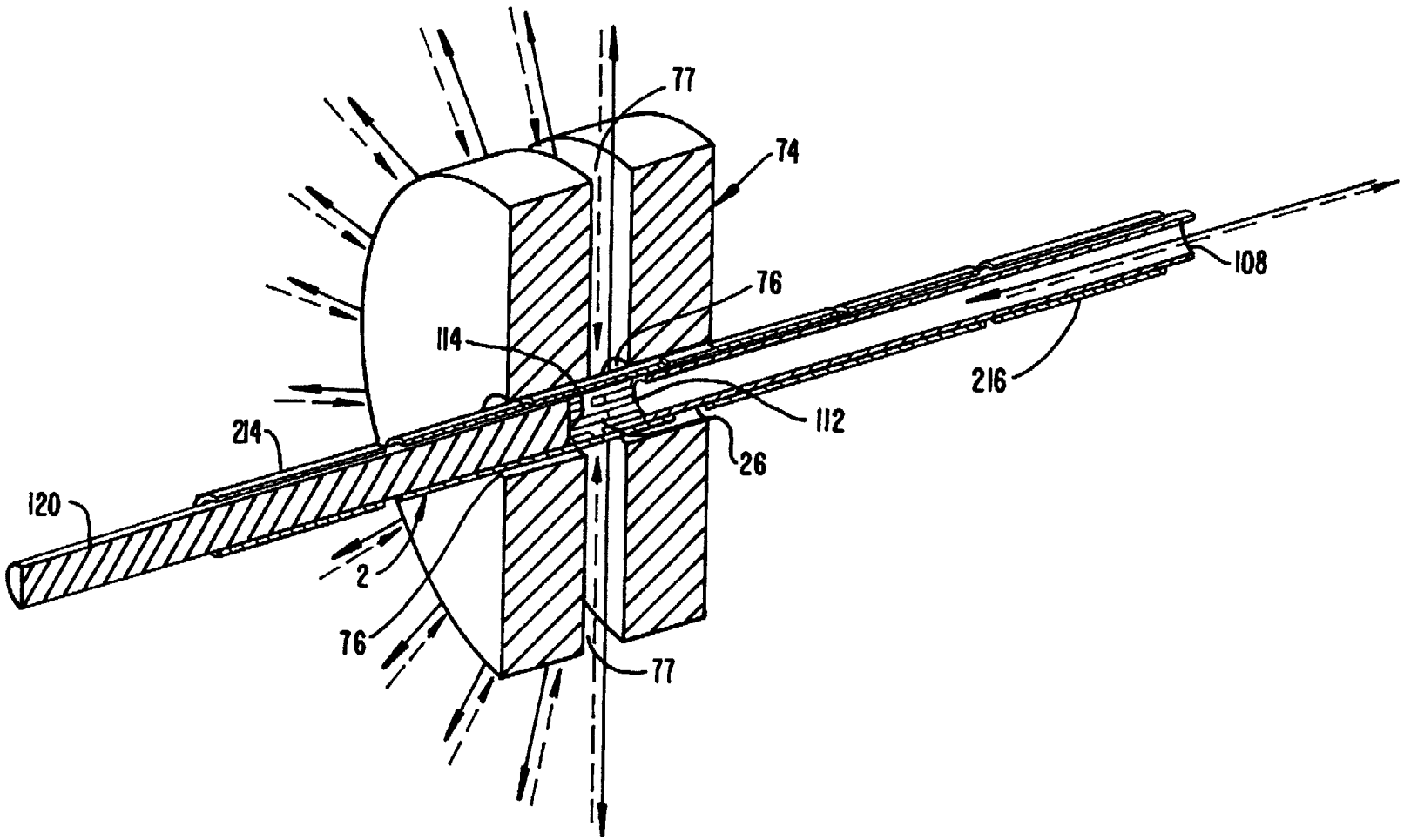
FIG. 7 is a partial isometric cross section of a stent in the apparatus of an alternative polishing system illustrating the flow of abrasive slurry.

FIG. 7 illustrates an alternative embodiment that may be suitable for polishing a large number of stents in a production mode. In this embodiment, body 74 defines a disk shaped gap 77 and an inner hole 76 for receiving the stent, as described above. Inlet/outlet tube 108 is fixedly located relative to body 74. Polishing apparatus 58 further includes a solid rod 120 supported by a suitable-stand (not shown) and extending through hole 76 of body 74. As shown in FIG. 7, rod 120 replaces inlet tube 106 of FIGS. 4 and 5 and is sized to fit within prosthesis 2 and to extend through body 74 with end 114 approximately at the position of tube end 110 of the earlier embodiment, leaving a longitudinal gap between the ends 114, 112, centered with and slightly larger than gap 77 in body 74. In this embodiment, the slurry flows into inner lumen 26 only from inlet/outlet tube 108 and radially outward/inward through openings 30 into gap 77. In a first operation mode, the flow of abrasive slurry is illustrated in FIG. 7 by the arrows.

Figure 8:
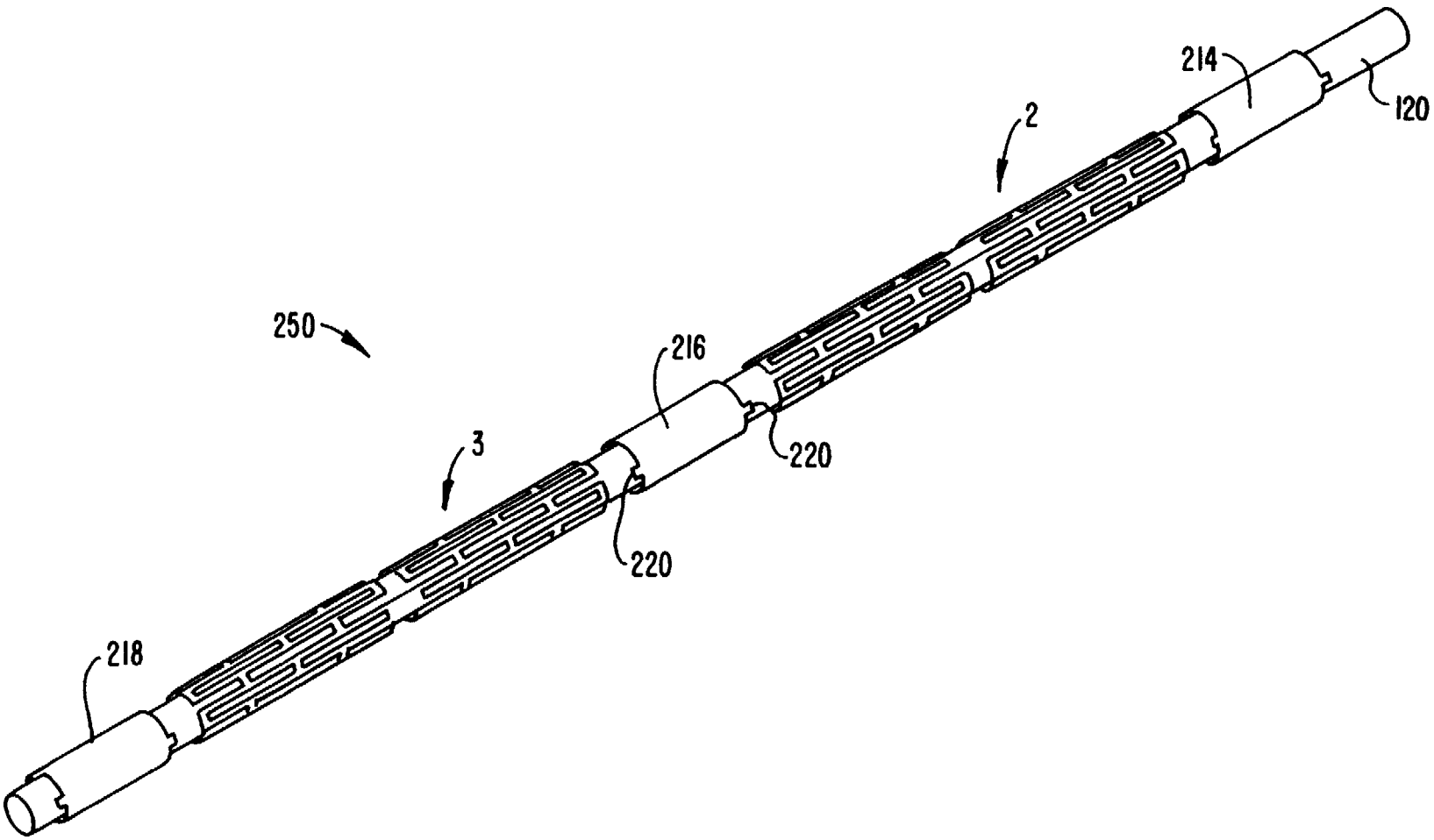
FIG. 8 is a representation of a solid rod supporting a series of stents separated by spacers for use with the alternative polishing system of FIG. 7.

FIG. 8 illustrates rod 120 having a train 250 of two stents 2, 3 and three separate spacers 214, 216, 218 mounted thereon (shown spaced apart for clarity). In this alternative configuration, stents 2, 3 need not be provided with tubular extensions 40, 42 since the stent is no longer mounted on a frame structure 92. Spacers 214, 216, 218 have substantially equivalent inner and outer diameters as stents 2, 3 and are provided with multiple protrusions 220 extending axially to allow the abrasive slurry to also deburr and polish the ends of stents 2, 3. Of course, it should be clearly understood that while only two stents and three spacers are shown, a larger number of stents interspaced by spacers may be mounted on a longer rod 120. In fact, this embodiment facilitates the polishing of a large number of stents in a batch process.

In a modified method from that described in the previous embodiment, a rod 120 having a number of completed stents with no tubular extensions, separated by spacers is installed as shown in the exemplary modified apparatus of FIG. 7 (note that only one stent 2 and two spacers 214, 216 are shown in FIG. 7). With rod 120 stationary with respect to the frame (not shown), the train 250 of stents and spacers may be advanced over rod 120 in a sliding relationship, to expose openings 30 in new sections of stent 2 to the flow of abrasive slurry within the open section of lumen 26. When one stent has been completely traversed across gap 77 in FIG. 7, for example from left to right, a spacer followed by a second stent may be equally traversed from left to right until all stents on rod 120 have been treated.

In a preferred method, once a suitable abrasive slurry has been selected and all gaps in the apparatus have been optimized for a particular type of stent, a rod 120 with a train 250 of stents and spacers will be mounted as described above. In a first operating mode, the abrasive slurry is propelled into tube 108 in the direction shown by the arrow in FIG. 7, and will exit radially through gap 77 in body 74 after passing through the exposed portion of the stent. The train 250 of stents and spacers will then be advanced over rod 120, for example, from left to right, until all stents have been treated and the train is in its full rightward position. In a second operating mode, the direction of flow of the abrasive slurry will be reversed from that shown by the arrows in FIG. 7 and the train of stents will be advanced from right to left until it is in its full leftward position. Preferably, upon completion of the above cycle, stents in the train will have been suitably deburred and polished and ready for chemical passivation and final inspection. The process can then be repeated with a new train of stents and spacers mounted on another rod. This embodiment facilitates the polishing of a large number of stents in a batch process.

Although the foregoing invention has been described in detail for purposes of clarity of understanding, it will be obvious that certain modifications may be practiced within the scope of the appended claims. For example, the polishing system may further include a control system for monitoring and controlling process parameters, such as media temperature, viscosity, wear and the flow rate, as well as the advance velocities of the stents across the gap.

What is claimed is:

1. A method for deburring and polishing a radially expansible lumenal prosthesis having a hollow elongate body with an inner lumen, wherein said body comprises a plurality of elongated longitudinal openings circumferentially spaced-apart about the body, the method comprising:

mounting the lumenal prosthesis within a chamber such that openings spaced around a circumference of the elongate body are fluidly coupled to the chamber; and radially extruding a flowable abrasive material through the openings around the circumference of the elongate body in abrading contact with cut surfaces and edges surrounding the openings, wherein all abrasive material flows from the lumen radially outwardly through the openings to the exterior of the prosthesis or from the exterior of the prosthesis radially inwardly to the lumen.

2. The method of claim 1 wherein the radially extruding step comprises introducing the flowable abrasive material into the inner lumen of the prosthesis body and directing the flowable abrasive material radially outward through the openings in the prosthesis body.

3. The method of claim 1 wherein the radially extruding step comprises:

mounting the lumenal prosthesis to a fixture; and introducing the flowable abrasive material into a gap of the fixture in communication with the prosthesis body and directing the flowable abrasive material radially inward through the openings in the prosthesis body.

4. The method of claim 2 wherein the radially extruding step is carried out by positioning a hollow tube through an open end of the prosthesis body and a solid rod through an opposite open end of the prosthesis and delivering the flowable abrasive material under pressure through the hollow tube into the inner lumen of the prosthesis body so that the flowable abrasive material is forced radially outward through the openings in the prosthesis body.

5. The method of claim 2 wherein the radially extruding step is carried out by positioning a hollow tube through an open end of the prosthesis body and a solid rod through an opposite open end of the prosthesis and delivering the flowable abrasive material under pressure radially inward through the openings in the prosthesis body into the inner lumen of the prosthesis body and through the hollow tube.

6. The method of claim 2 wherein the radially extruding step is carried out by positioning a first hollow tube through an open end of the prosthesis body and a second hollow tube through a second open end of the prosthesis body opposite the first open end and delivering the flowable abrasive material under pressure through the first and second hollow tubes into the inner lumen of the prosthesis body such that the flowable abrasive material is forced radially outward through the openings in the prosthesis body.

7. The method of claim 2 wherein the radially extruding step is carried out by positioning a first hollow tube through a first open end of the prosthesis body and a second hollow tube through a second open end of the prosthesis body opposite the first open end and delivering the flowable abrasive material under pressure radially inward through the openings in the prosthesis body into the inner lumen and through the first and second hollow tubes.

8. A method for deburring and polishing a radially expansible lumenal prosthesis having a hollow elongate body, the method comprising:

mounting the lumenal prosthesis adjacent a fluid conduit;

radially extruding a flowable abrasive material through the fluid conduit and through openings on a circumference of the elongate body in abrading contact with cut surfaces and edges surrounding the openings;

providing hollow, tubular extensions to first and second ends of the prosthesis; and mounting the tubular extensions to a fixture.

9. The method of claim 8 wherein the mounting step further comprises mounting each of the tubular extensions within a frame movably coupled to the fixture such that at least a portion of the prosthesis body extends through a hole in the fixture.

10. The method of claim 9 wherein the fixture defines an annular chamber in communication with the hole, the method further comprising radially extruding the flowable abrasive material through openings circumferentially spaced about the prosthesis body into the annular chamber.

11. The method of claim 8 wherein the radially extruding step further comprises reciprocating the tubular extensions in an axial direction relative to the fixture such that the cut surfaces and edges surrounding substantially all of the circumferential openings in the prosthesis body will be in abrading contact with the flowable abrasive material.

12. The method of claim 1 wherein the extruding step further comprises:

mounting the lumenal prosthesis within a hole of a fixture;

delivering the flowable abrasive material through a passage in communication with the hole; and extruding a portion of the flowable abrasive material through a passage defined by outer surfaces of the prosthesis body and an inner surface of the hole to abrade said outer surfaces.

13. The method of claim 1 wherein the extruding step further comprises:

positioning first and second tubes through first and second open ends of the lumenal prosthesis;

delivering the flowable abrasive material into the inner lumen of the prosthesis between open ends of the first and second tubes; and extruding a portion of the flowable abrasive material through a passage defined by an outer surface of the first and second tubes and inner surfaces of the prosthesis body to abrade said inner surfaces.

14. The method of claim 1 further comprising:

providing a train of prostheses spaced apart by spacers and disposed along a solid rod;

guiding a first prosthesis in the train of prostheses in a longitudinal direction over the solid rod so that at least a portion of the first prosthesis is extends through an annular chamber within a fixture;

radially extruding the flowable abrasive material through the openings in the circumference of the first prosthesis;

guiding the first prosthesis in the longitudinal direction out of the fixture; and guiding a second prosthesis in the train of prostheses over the solid rod in the longitudinal direction so that at least a portion of the second prosthesis extends through the annular chamber within the fixture.

15. The method of claim 14 wherein the radially extruding step is carried out by positioning a hollow tube through an open end of the prostheses opposite the solid rod and delivering the flowable abrasive material under pressure through the hollow tube into the inner lumen of the prosthesis body so that the flowable abrasive material is forced radially outward through the openings in the prosthesis body.

16. The method of claim 15 wherein the train of prostheses are advanced along the solid rod toward the hollow tube as the flowable abrasive material is extruded radially outward through said openings in the prostheses.

17. The method of claim 14 wherein the radially extruding step is carried out by positioning a hollow tube through an open end of the prostheses opposite the solid rod and radially extruding the flowable abrasive material radially inward through the openings in the circumference of the prostheses and into the hollow tube.

18. The method of claim 17 wherein the train of prostheses are advanced along the solid rod away from the hollow tube as the flowable abrasive material is extruded radially inward through said openings in the prostheses.

19. The method of claim 14 wherein the first solid rod and the first train of prostheses are replaced by a second solid rod and a second train of prostheses after the openings in the prostheses of the first train of prostheses have been polished and deburred.

20. The method of claim 1 wherein the flowable abrasive material comprises abrasive particles suspended in a semisolid carrier.

21. The method of claim 20 wherein the abrasive particles are selected from the group consisting of silica, alumina, carborundum, garnet, tungsten carbide, silicon carbide and diamond.

22. The method of claim 20 wherein the semisolid carrier comprises a polyborosiloxane.

23. An apparatus for deburring and polishing a radially expansible lumenal prosthesis having an elongate body sized for delivery through an anatomical lumen and having an inner lumen, wherein said body comprises a plurality of elongated longitudinal openings circumferentially spaced-apart about the body, the apparatus comprising:

a fixture defining a chamber for receiving at least a portion of the lumenal prosthesis; and a fluid hydraulic system in communication with the chamber or radially extruding the flowable abrasive material through openings spaced around a circumference of the prosthesis body in abrading contact with cut surfaces and edges surrounding the openings, wherein the system directs all flow of abrasive material from the lumen radially outwardly through the openings to the exterior of the prosthesis or from the exterior of the prosthesis radially inwardly to the lumen.

24. The apparatus of claim 23 wherein the fixture defines a hole sized for receiving the lumenal prosthesis and an annular chamber circumscribing a portion of the hole, the fluid hydraulic system being in communication with the annular chamber for delivering the flowable abrasive material into the annular chamber and radially inward through the openings and into the inner lumen of the prosthesis.

25. An apparatus for deburring and polishing a radially expansible lumenal prosthesis having an elongate body sized for delivery through an anatomical lumen, the apparatus comprising:

a fixture defining a chamber for receiving at least a portion of the lumenal prosthesis; and a fluid conduit in communication with the chamber for radially extruding the flowable abrasive material through opening in the circumference of the prosthesis body in abrading contact with cut surfaces and edges surrounding the openings;

wherein the fluid conduit is a hollow tube sized for positioning through an open end of the lumenal prosthesis into the inner lumen, the hollow tube having an inlet adapted for receiving a flowable abrasive material and an outlet in communication with the inner lumen for delivering the flowable abrasive material under pressure into the inner lumen.

26. The apparatus of claim 25 further comprising an elongate flow restrictor sized for introduction through a second open end of the lumenal prosthesis opposite the first open end for inhibiting flow through said second open end so that the flowable abrasive material delivered into the inner lumen is radially extruded through the openings in the prosthesis body.

27. The apparatus of claim 25 further comprising a second hollow tube sized for introduction through a second open end of the lumenal prosthesis opposite the first open end, the second tube having an inlet adapted for receiving a flowable abrasive material and an outlet in communication with the inner lumen for delivering the flowable abrasive material under pressure into the inner lumen.

28. The apparatus of claim 27 wherein the tubes are sized to define an annular gap between the tubes and inner surfaces of the prosthesis such that a portion of the flowable abrasive material flows through the annular gap in abrading contact with the inner surfaces of the prosthesis.

29. The apparatus of claim 28 wherein the annular gap offers a greater resistance to flow than the openings in the prosthesis body so that a substantial portion of the flowable abrasive material is extruded through the openings in abrading contact with the cut surfaces and edges surrounding said openings.

30. The apparatus of claim 24 wherein the hole in the fixture is sized to define a restrictive passage between outer surfaces of the lumenal prosthesis and an inner surface of the hole, the restrictive passage offering a greater resistance to flow than the openings in the circumference of the prosthesis body such that the flowable abrasive material delivered into the annular chamber primarily flows through the circumferential openings of the prothesis body and secondarily flows through the restrictive passage in abrading contact with the outer surfaces of the prosthesis body.

31. An apparatus for deburring and polishing a radially expansible lumenal prosthesis having an elongate body sized for delivery through an anatomical lumen, the apparatus comprising:

a fixture defining a chamber for receiving at least a portion of the lumenal prosthesis; and a fluid conduit in communication with the chamber for radially extruding the flowable abrasive material through openings in the circumference of the prosthesis body in abrading contact with cut surfaces and edges surrounding the openings;

wherein the fixture comprises a base and a mount coupled to the base for holding the lumenal prosthesis such that said portion of the lumenal prosthesis is disposed within the chamber, the mount comprising first and second mounting arms extending from the base on opposite sides of the chamber, the mounting arms each being adapted to hold an end portion of the prosthesis body.

32. The apparatus of claim 31 wherein the mounting arms are movably coupled to the base, the apparatus further comprising a drive for axially reciprocating the prosthesis body relative to the hole.

33. The apparatus of claim 26 wherein the elongate flow restrictor is a guide rod for supporting a train of lumenal prostheses longitudinally spaced apart by spacers.

34. The apparatus of claim 33 further comprising means for axially translating the train of lumenal prostheses along the guide rod.

35. A system for deburring and polishing a radially expansible lumenal prosthesis sized for delivery through an anatomical lumen and having an elongate, hollow body defining an inner lumen, the apparatus comprising:

a supply of flowable abrasive material;

a polishing assembly defining a chamber for holding at least a portion of the lumenal prosthesis within the chamber;

a fluid conduit having an inlet in communication with the supply of flowable abrasive material and an outlet in communication with the chamber, wherein said body comprises a plurality of elongated longitudinal openings circumferentially spaced-apart about the body; and a pump for delivering the abrasive material under pressure through the fluid conduit and radially forcing the abrasive material through openings spaced around a circumference of the lumenal prosthesis in abrading contact with cut surfaces and edges surrounding the openings, wherein the system directs all flow of abrasive material from the lumen radially outwardly through the openings to the exterior of the prosthesis or from the exterior of the prosthesis radially inwardly to the lumen.

36. The system of claim 35 wherein the flowable abrasive material comprises abrasive particles suspended in a semisolid carrier.

37. The apparatus of claim 36 wherein the abrasive particles are selected from the group consisting of silica, alumina, carborundum, garnet, tungsten carbide, silicon carbide and diamond.

38. The method of claim 36 wherein the semisolid carrier comprises a polyborosiloxane.

39. The method of claim 1 wherein the chamber is an annulus completely surrounding an axial Section of the elongate body, the method comprising directing the flowable abrasive material between the inner lumen of the prosthesis and the annulus through openings spaced around the entire circumference of the axial section.

40. The method of claim 39 further comprising;

moving the prosthesis relative to the annulus such that the annulus surrounds a second axial section of the prothesis; and radially extruding a flowable abrasive material through openings in the second axial section of the prothesis between the annulus and the inner lumen of the prosthesis in abrading contact with cut surfaces and edges surrounding the openings.

41. The method of claim 1 wherein the elongate body has first and second opposing open ends, the method further comprising introducing the flowable abrasive material through the first and second open ends into the inner lumen of the elongate body and preferentially directing the flowable abrasive material radially outward through the openings in the elongate body.

42. The method of claim 1 wherein the elongate body has first and second opposing open ends, the method further comprising introducing the flowable abrasive material into the chamber around the elongate body and preferentially directing the flowable abrasive material radially inward through the openings into the inner lumen and through the first and second open ends of the prosthesis.

43. The method of claim 1 wherein the elongate body has first and second opposing open ends, the method further comprising introducing the flowable abrasive material through the first open end into the inner lumen of the elongate body and increasing a flow resistance through the second open end such that the flowable abrasive material preferentially flows radially outward through the openings in the elongate body to the chamber.

44. The method of claim 1 wherein the elongate body has first and second opposing open ends, the method further comprising introducing the flowable abrasive material into the chamber around the elongate body and preferentially directing the flowable abrasive material radially inward through the openings into the inner lumen and through the first open end of the prosthesis.

45. The apparatus of claim 23 wherein the chamber is an annulus sized to completely surround an axial section of the elongate body such that the flowable abrasive material may be directed through openings spaced around the entire circumference of the axial section.

46. The apparatus of 45 further comprising a drive for moving the prosthesis relative to the annular chamber such that the annulus surrounds a second axial section of the prosthesis.

47. The apparatus of claim 23 wherein the prosthesis has first and second opposing open ends, the apparatus further comprising a fluid conduit coupling the fluid hydraulic system with the first open end of the prosthesis and a fluid blocking element adapted for positioning adjacent to or within the second open end of the prosthesis for introducing the flowable abrasive material through the first open end into the inner lumen of the elongate body and preferentially directing the flowable abrasive material radially outward through the openings in the elongate body.

48. The apparatus of claim 23 wherein the prothesis has first and second opposing open ends, the apparatus further comprising a fluid conduit coupling the fluid hydraulic chamber with the annulus for introducing the flowable abrasive material into the annulus around the elongate body and directing the flowable abrasive material radially inward through the openings into the inner lumen, the apparatus further comprising a fluid blocking element adapted for positioning adjacent to or within the second open end of the prosthesis for preferentially directing the abrasive material through the first open end.

49. The apparatus of claim 23 wherein the prosthesis has first and second opposing open ends, the apparatus further comprising one or more fluid conduits coupling the fluid hydraulic system with the first and second open ends of the prosthesis for introducing the flowable abrasive material into the inner lumen of the elongate body and preferentially directing the flowable abrasive material radially outward through the openings in the elongate body.

50. The apparatus of claim 24 further comprising first and second fluid conduits coupled to first and second open ends of the prosthesis for preferentially directing the abrasive material from the inner lumen through the first and second open ends into the first and second fluid conduits.

* * * * *